US008591247B2

(12) United States Patent
Zhu

(10) Patent No.: US 8,591,247 B2
(45) Date of Patent: Nov. 26, 2013

(54) ELECTRICAL CONNECTOR ASSEMBLY WITH IMPROVED LATCH MECHANISM

(75) Inventor: Huan-Xiang Zhu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/400,869

(22) Filed: Feb. 21, 2012

(65) Prior Publication Data

US 2012/0214325 A1 Aug. 23, 2012

(51) Int. Cl.
*H01R 13/627* (2006.01)

(52) U.S. Cl.
USPC ..... 439/352

(58) Field of Classification Search
USPC ..... 439/350, 351, 352, 353, 354, 357, 358, 439/304
See application file for complete search history.

(56) References Cited

U.S. PATENT DOCUMENTS

| | | | | |
|---|---|---|---|---|
| 4,310,211 | A * | 1/1982 | Bunnell et al. | 439/358 |
| 4,460,232 | A * | 7/1984 | Sotolongo | 439/535 |
| 5,277,627 | A * | 1/1994 | Matsuzaki | 439/677 |
| 6,203,354 | B1 * | 3/2001 | Kuwahara et al. | 439/357 |
| 7,201,608 | B2 * | 4/2007 | Rosenberger et al. | 439/578 |
| 7,252,565 | B2 * | 8/2007 | Hunter | 439/357 |
| 7,484,988 | B2 * | 2/2009 | Ma et al. | 439/350 |
| 7,699,651 | B2 * | 4/2010 | Rosenberger et al. | 439/578 |
| 7,850,476 | B2 * | 12/2010 | Good | 439/358 |
| 7,867,008 | B1 * | 1/2011 | Lin | 439/350 |
| 2004/0092186 | A1 * | 5/2004 | Wilson-Nguyen et al. | 442/181 |
| 2009/0318004 | A1 * | 12/2009 | Cours | 439/304 |
| 2010/0105238 | A1 * | 4/2010 | Good | 439/357 |
| 2011/0028023 | A1 * | 2/2011 | Mahoney | 439/353 |
| 2011/0312206 | A1 * | 12/2011 | Seido | 439/352 |

* cited by examiner

*Primary Examiner* — Ross Gushi
(74) *Attorney, Agent, or Firm* — Wei Te Chung; Ming-Chieh Chang

(57) ABSTRACT

A plug connector comprises a plug housing (11) having a front base portion (112) extending along a mating direction and a rear linking portion (114), a contact (12) received in the base portion, a cover (13) assembled to the linking portion, and a cable (14) electrically connected with the contact. The base portion defines a front face (1120), a pair of protrusions (1121) on an upper and a lower sides thereof, and a pair of receiving slots (1123), each protrusion defining a receiving channel (1122) extending along a transverse direction, each receiving slot extending from the front surface along the mating direction to a corresponding receiving channel.

13 Claims, 8 Drawing Sheets

ELECTRICAL CONNECTOR ASSEMBLY WITH IMPROVED LATCH MECHANISM

BACKGROUND OF THE INVENTION

1. Field of the Invention

The present invention generally relates to an electrical connector assembly, and more particularly to an electrical connector assembly for establishing an electrical connection of a photovoltaic module for a solar energy system.

2. Description of Related Art

Photovoltaic conversion device converts solar radiation to electrical power by solar photovoltaic technology, and the photovoltaic conversion device usually works with semiconductor components. Additionally, an electrical connector is required in the conversion.

U.S. Pat. No. 7,484,988 issued to Ma et al. on Feb. 3, 2009 discloses an electrical connector assembly having a plug connector and a receptacle connector mating with each other to form an electrical connection. The plug connector has a latch portion locking with the receptacle connector, and users can manipulate the latch portion to disengage the plug connector from the receptacle connector. A clamping collar is provided to cooperate with the latch portion for enhancing positive engagement between the plug connector and the receptacle connector.

Hence, it is desirable to have a simple latching structure.

BRIEF SUMMARY OF THE INVENTION

Accordingly, the object of the present invention is to provide an electrical connector assembly with an improved latch mechanism.

In order to achieve the above-mentioned object, a plug connector comprises a plug housing having a front base portion extending along a mating direction and a rear linking portion, a contact received in the base portion, a cover assembled to the linking portion, and a cable electrically connected with the contact. The base portion defines a front face, a pair of protrusions on an upper and a lower sides thereof, and a pair of receiving slots, each protrusion defining a receiving channel extending along a transverse direction, each receiving slot extending from the front surface along the mating direction to a corresponding receiving channel.

Other objects, advantages and novel features of the invention will become more apparent from the following detailed description of the present embodiment when taken in conjunction with the accompanying drawings.

DETAILED DESCRIPTION OF THE INVENTION

Figure 1:
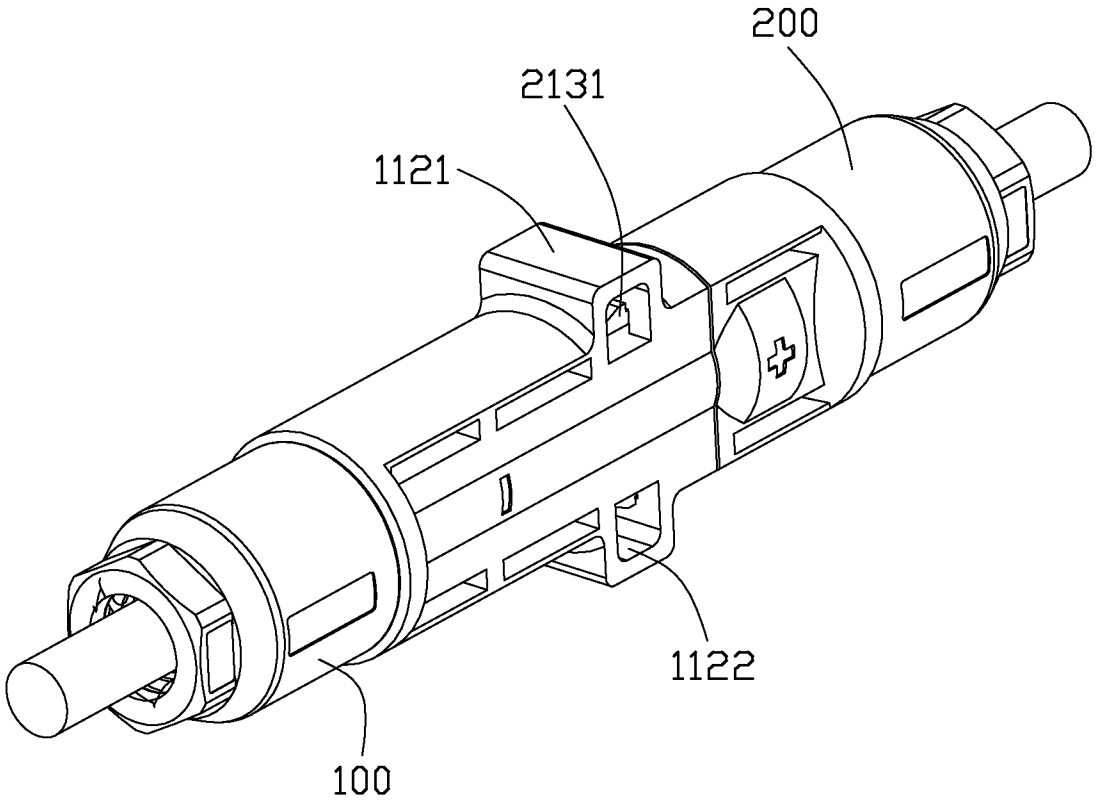
FIG. 1 is an assembled view of an electrical connector assembly in accordance with the present invention.

Reference will now be made to the drawing figures to describe the present invention in detail.

Figure 2:
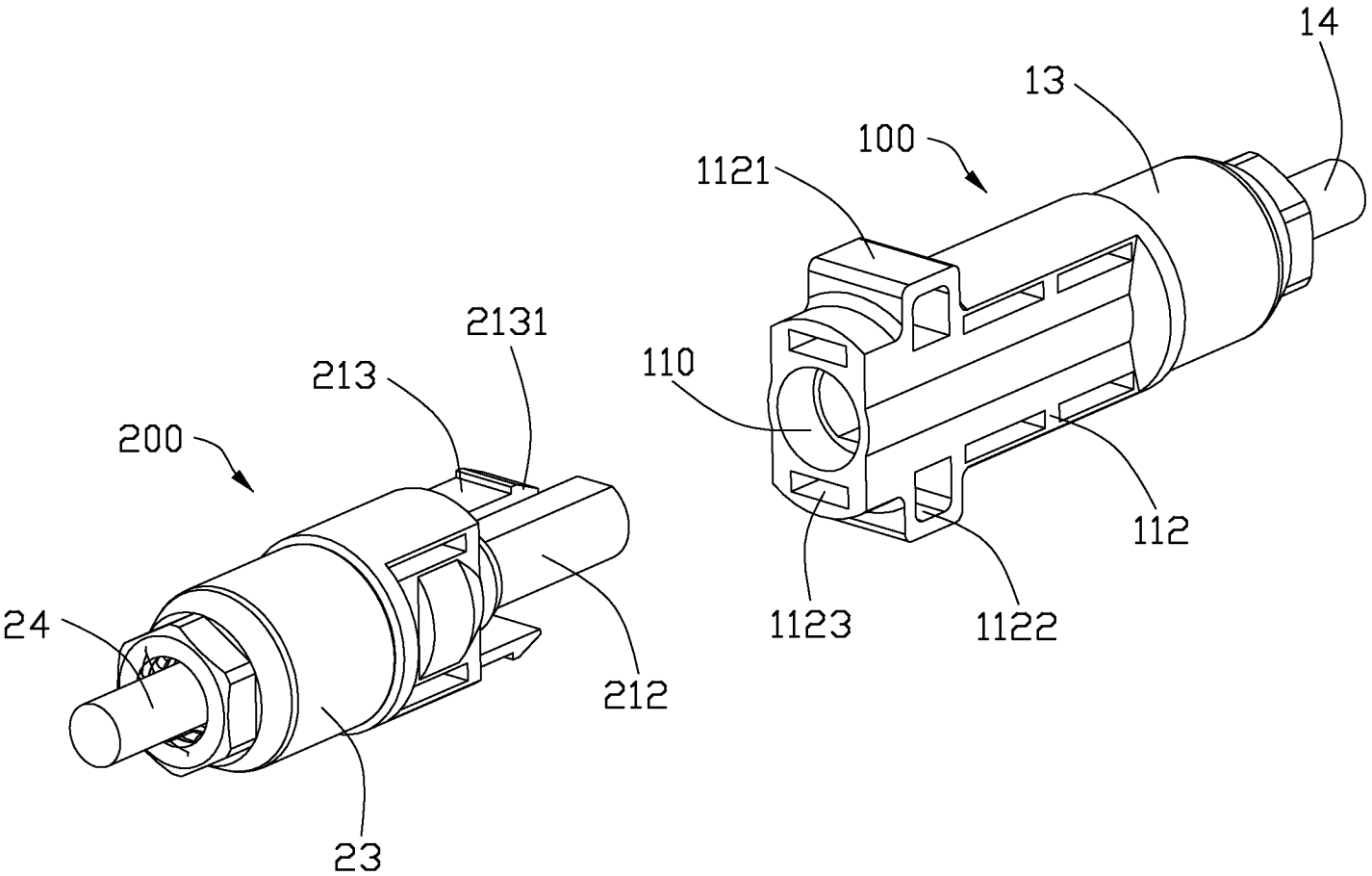
FIG. 2 is an exploded, perspective view of the electrical connector assembly shown in FIG. 1.
Figure 3:
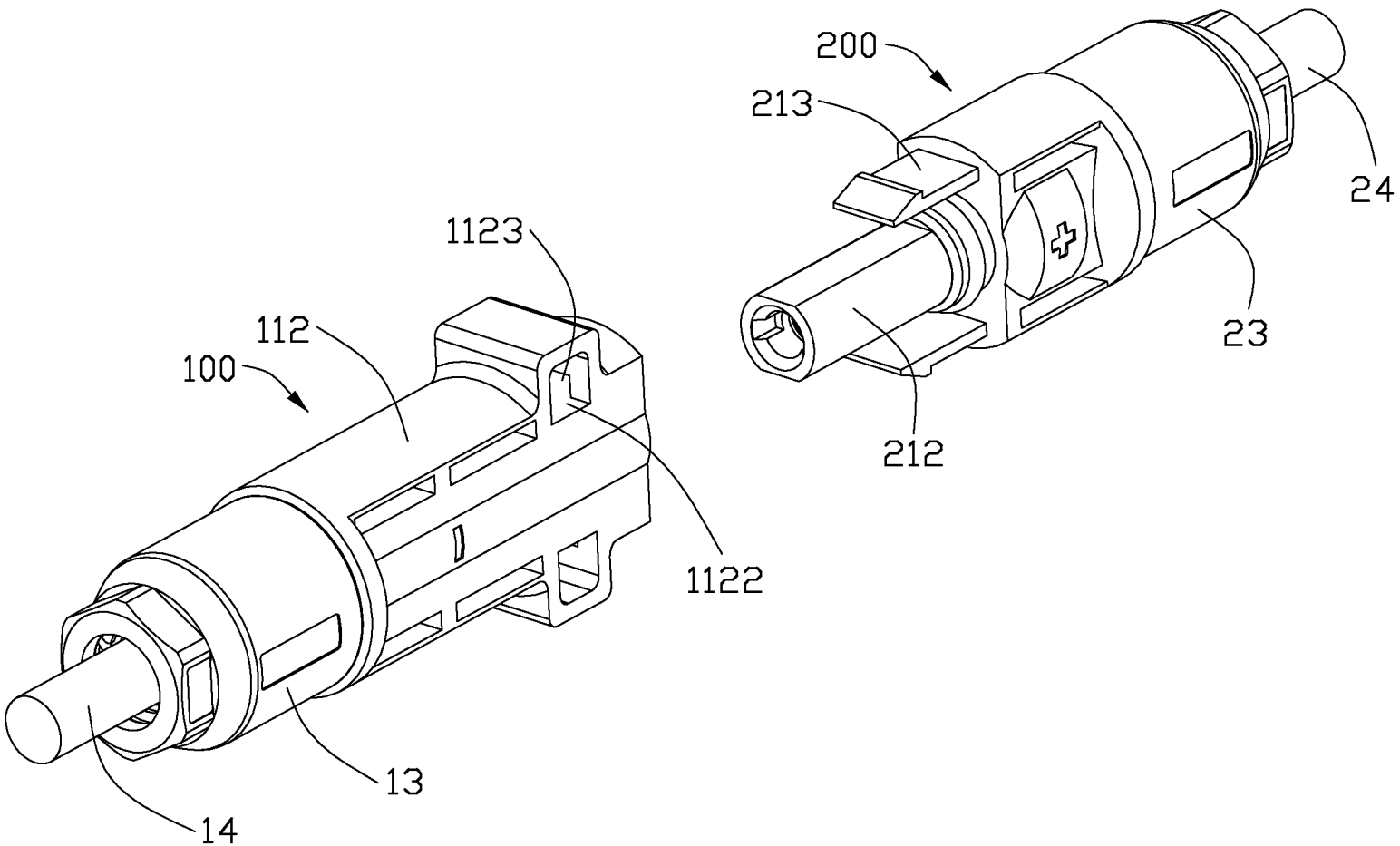
FIG. 3 is similar to FIG. 2, but viewed from another aspect.

Referring to FIGS. 1-3, an electrical connector assembly made in accordance with the present invention comprises a plug connector 100 and a receptacle connector 200, when the plug connector 100 mating with the receptacle connector 200, users must use an unlocking tool to disengage the two connectors.

Figure 4:
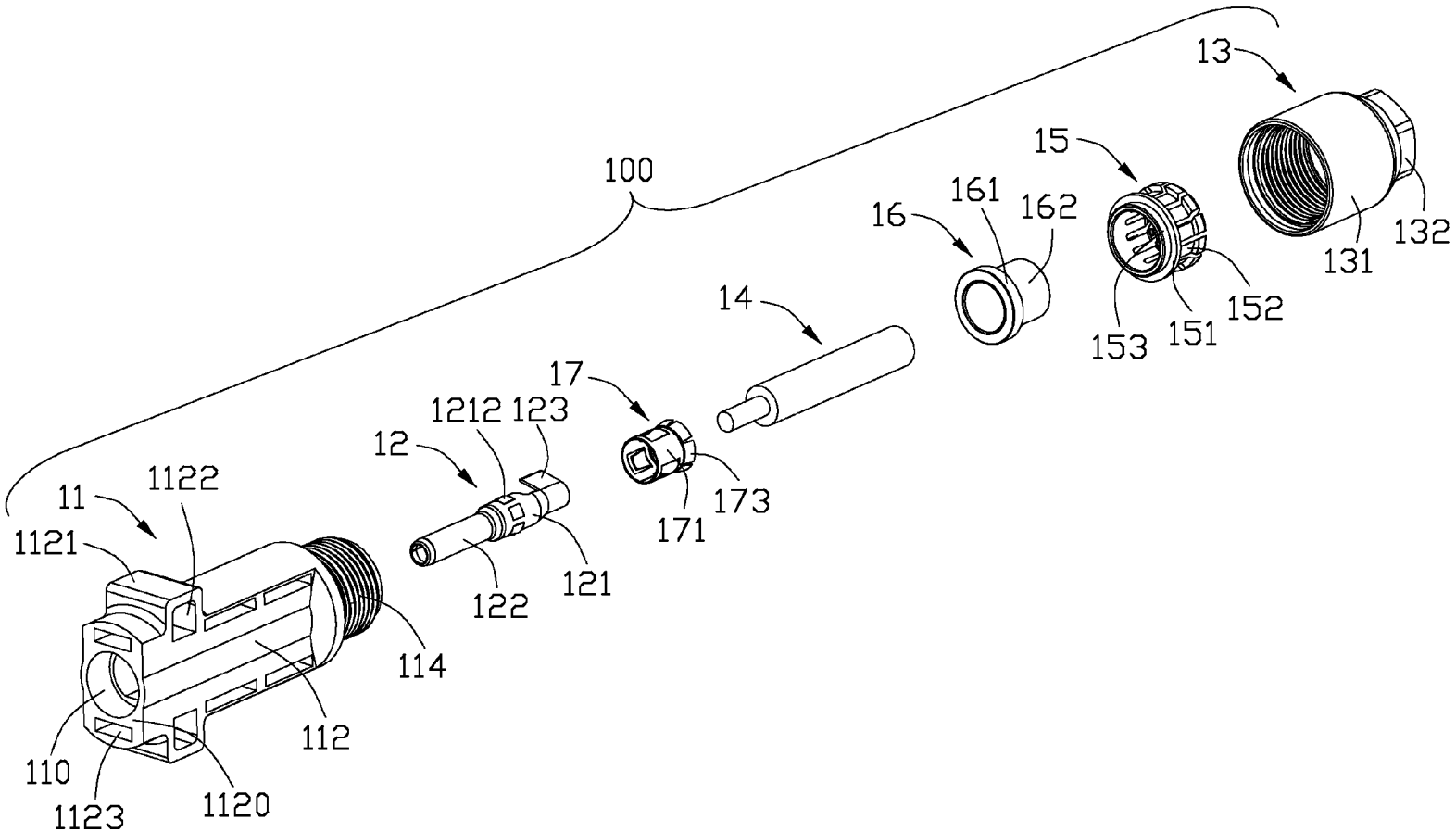
FIG. 4 is an exploded, perspective view of a plug connector of the electrical connector assembly shown in FIG. 2.
Figure 5:
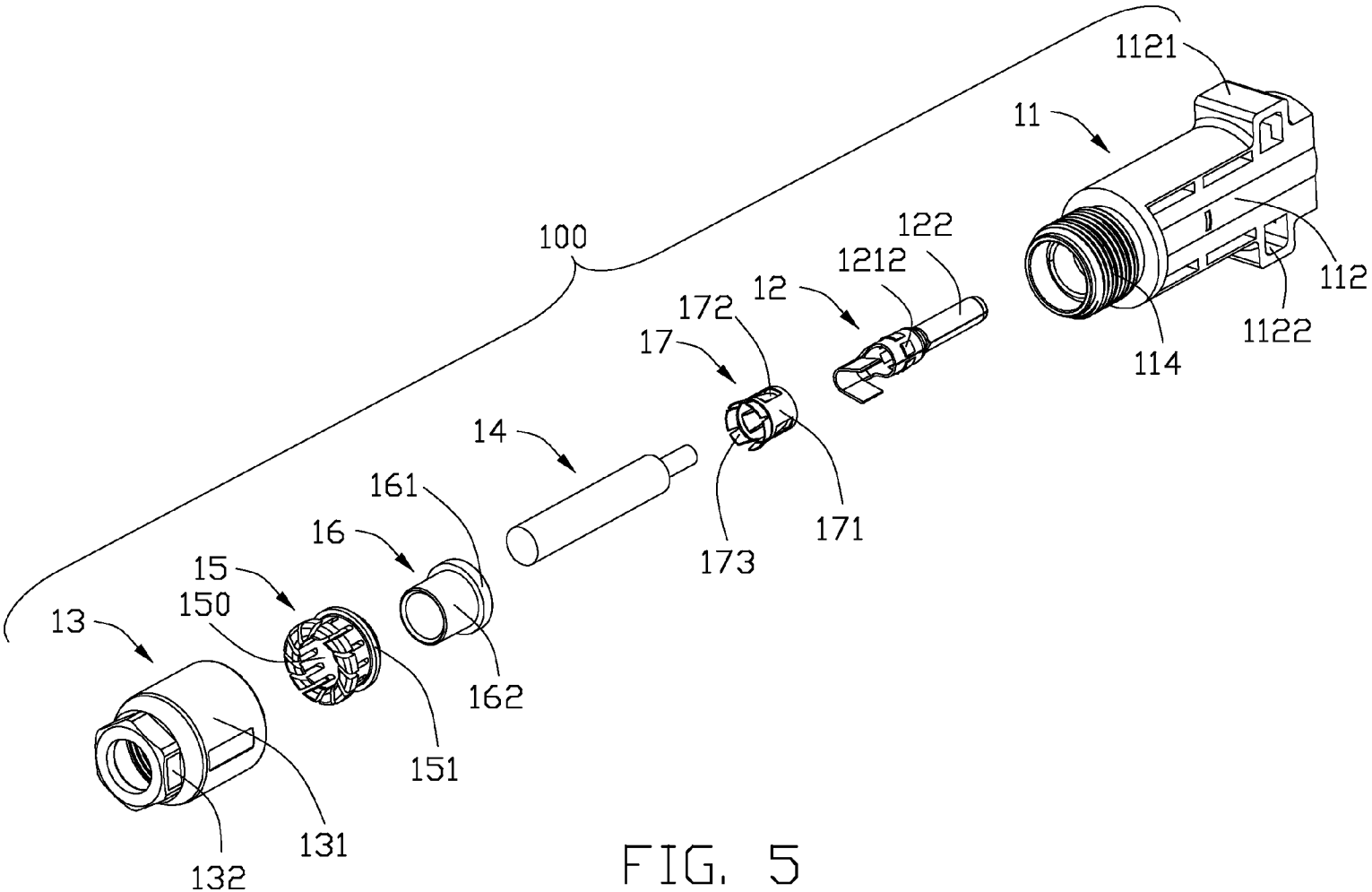
FIG. 5 is similar to FIG. 4, but viewed from another aspect.
Figure 8:
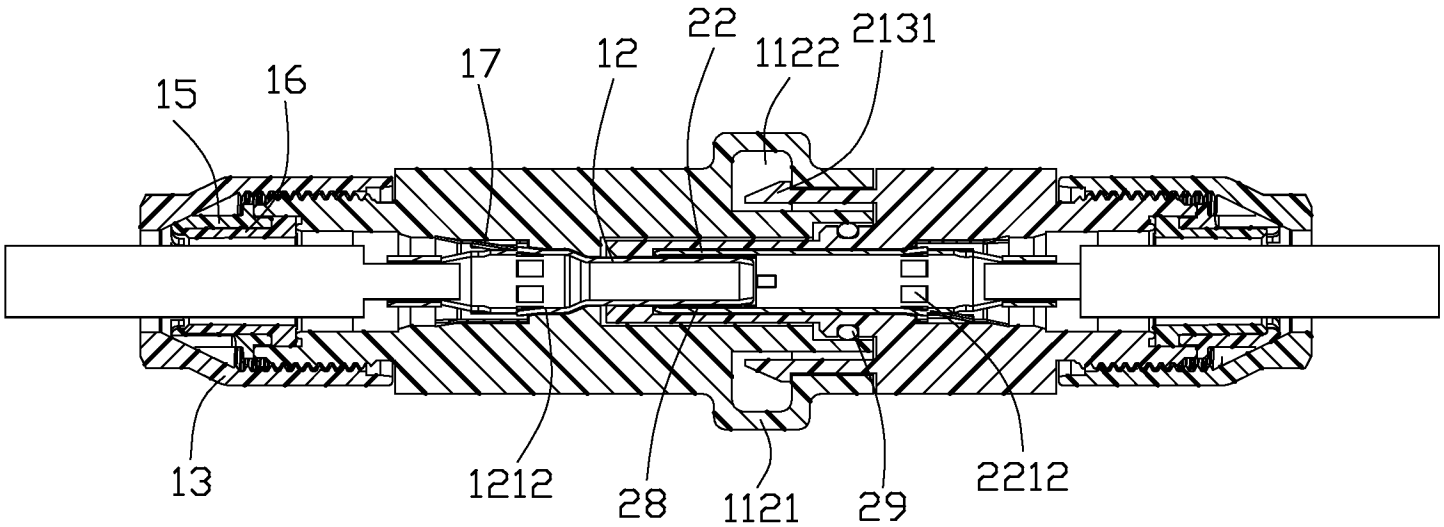
FIG. 8 is a cross-section view when the plug connector inserted into the receptacle connector of the electrical connector assembly.

Referring to FIGS. 4-5, and conjunction with FIG. 8, the plug connector 100 comprises an insulative plug housing 11, a columned contact 12 received in the plug housing 11, a cover 13 assembled to a rear end of the plug housing 11 and a cable 14 electrically connected with the columned contact 12. The plug housing 11 comprises a base portion 112 extending along a mating direction and a linking portion 114 extending rearwards from the base portion 112, and the diameter of the linking portion 114 is smaller than the base portion 112, a continuous thread is defined on an exterior surface of the linking portion 114. A pair of protrusions 1121 are disposed on a top and a lower side of the base portion 112, and the protrusions 1121 are extruding outwards symmetrically and neighboring to a front surface 1120 of the base portion 112.

Each protrusion 1121 defines a receiving channel 1122 extending through thereof along a direction perpendicular to the mating direction, thus the receiving channel 1122 is extending through the corresponding protrusion 1121 along a transverse direction completely. The base portion 112 has a circular receiving space 110 along a central axis thereof and a pair of rectangular receiving slots 1123 recessed backwards from the front surface 1120 thereof, and the receiving slots 1123 are disposed symmetrically with regard to the receiving space 110 and in front of the protrusions 1121. The receiving slots 1123 are extending rearwards along the mating direction and communicated with the corresponding receiving channels 1122 on a same side.

The columned contact 12 is made of metallic material and comprises a body portion 121, a contacting portion 122 extending forwards from the body portion 121 and a tail portion 123 behind the body portion 121. The contacting portion 122 is defined with a hollow shape and has a thinner outer diameter than the body portion 121. A plurality of barbs 1212 are disposed on the body portion 121 equably, the barbs 1212 are connected with the body portion 121 by front ends thereof, and back ends of the barbs 1212 are extending outwards.

The cover 13 comprises a first sleeve portion 131 in a front segment and a second sleeve portion 132 in a back segment thereof. The first sleeve portion 131 is of circular shape along a transverse cross-section view and has an inner thread on an inner wall thereof, the second sleeve portion 132 is polygonal along the transverse cross-section view and thinner than the first sleeve portion 131.

The plug connector 100 also has a shrinkable member 15 and a sealing washer 16. The shrinkable member 15 comprises a first stopping portion 151, a number of elastic portions 152 extending rearwards from a back end of the first stopping portion 151, and a second stopping portion 153 extending forwards from a front end of the first stopping portion 151. The first stopping portion 151 has a larger diameter than the second stopping portion 153, that is to say, the first stopping portion 151 is protruding outwards from an exterior surface of the second stopping portion 153. The sealing washer 16 is made of rubber material and comprises a first combining portion 161 and a second combining portion 162 extending rearwards from the first combining portion 161.

A metallic ring 17 is enclosing the columned contact 12, to prevent the columned contact 12 moving backwards relative to the plug housing 11. The ring 17 has a hollow column 171 at a front segment thereof, and the column 171 defines a plurality of bending portions 172 extending inwards. The ring 17 has several tabs 173 extending rearwards from a back end of the column 171, and the tabs 173 are extending outwards.

In assembly, the columned contact 12 is enclosed in the ring 17, a front end of the ring 17 is adjacent to the barbs 1212 of the columned contact 12. The columned contact 12 is assembled to the plug housing 11, the contacting portion 122 is located in the receiving space 110 of the plug housing 11, and the tail portion 123 of the plug contact 12 is connected with the cable 14. The second combining portion 162 of the sealing washer 16 is inserted into a gateway 150 of the shrinkable member 15, and the second combining portion 162 is fully filled in the gateway 150. The cable 14 are inserted into the sealing washer 16 and the shrinkable member 15, and the sealing washer 16 and the shrinkable member 15 are sliding along the axis direction till the first combining portion 161 of the sealing washer 16 inserted into the linking portion 114 of the plug housing 11. The cover 13 is assembled to the linking portion 114 along a back-to-front direction and enclosing the shrinkable member 15 therein. The second stopping portion 153 of the shrinkable member 15 is adjacent to a back end of the first combining portion 161 of the sealing washer 16.

Figure 6:
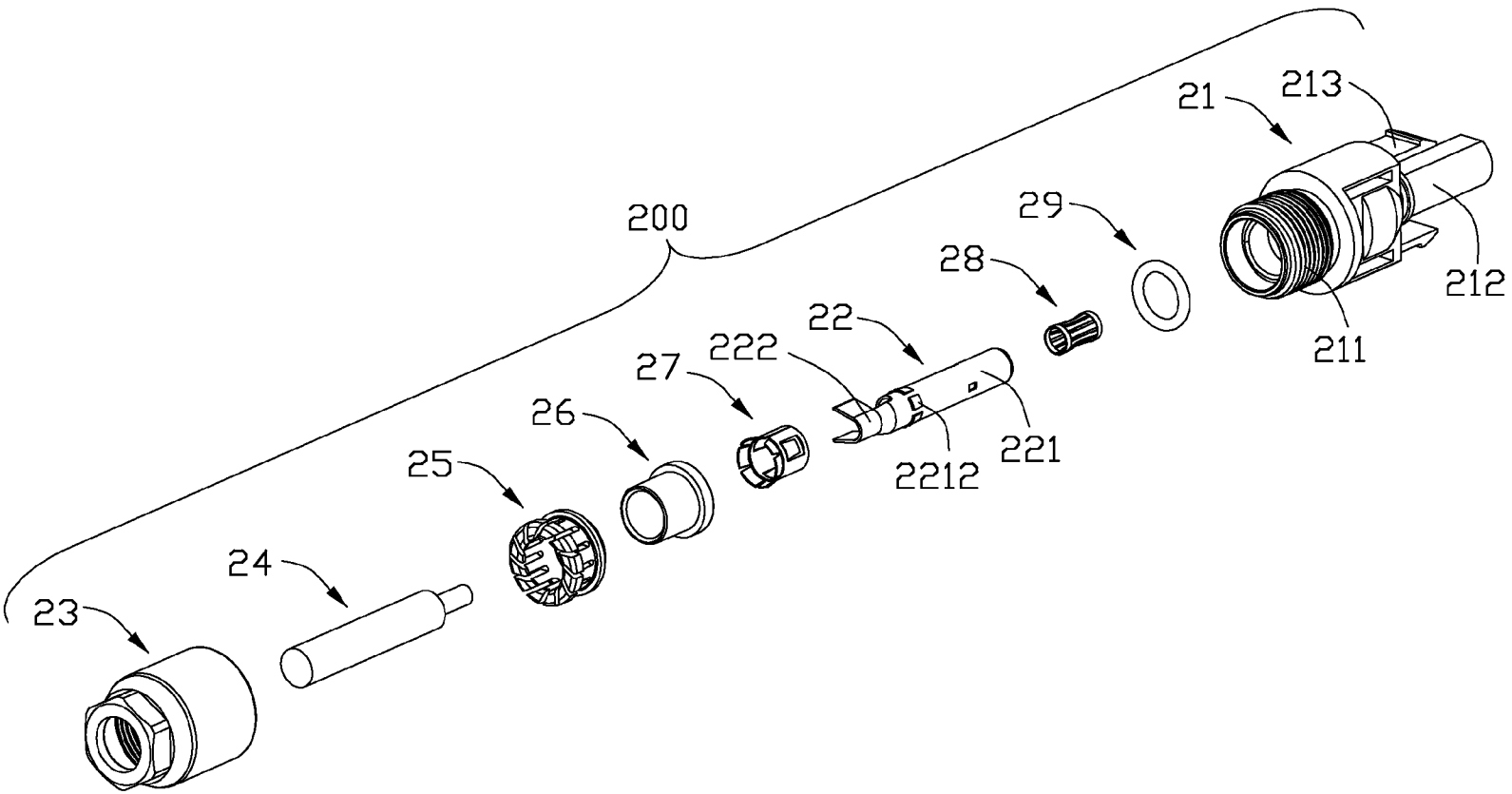
FIG. 6 is an exploded, perspective view of a receptacle connector of the electrical connector assembly shown in FIG. 2.
Figure 7:
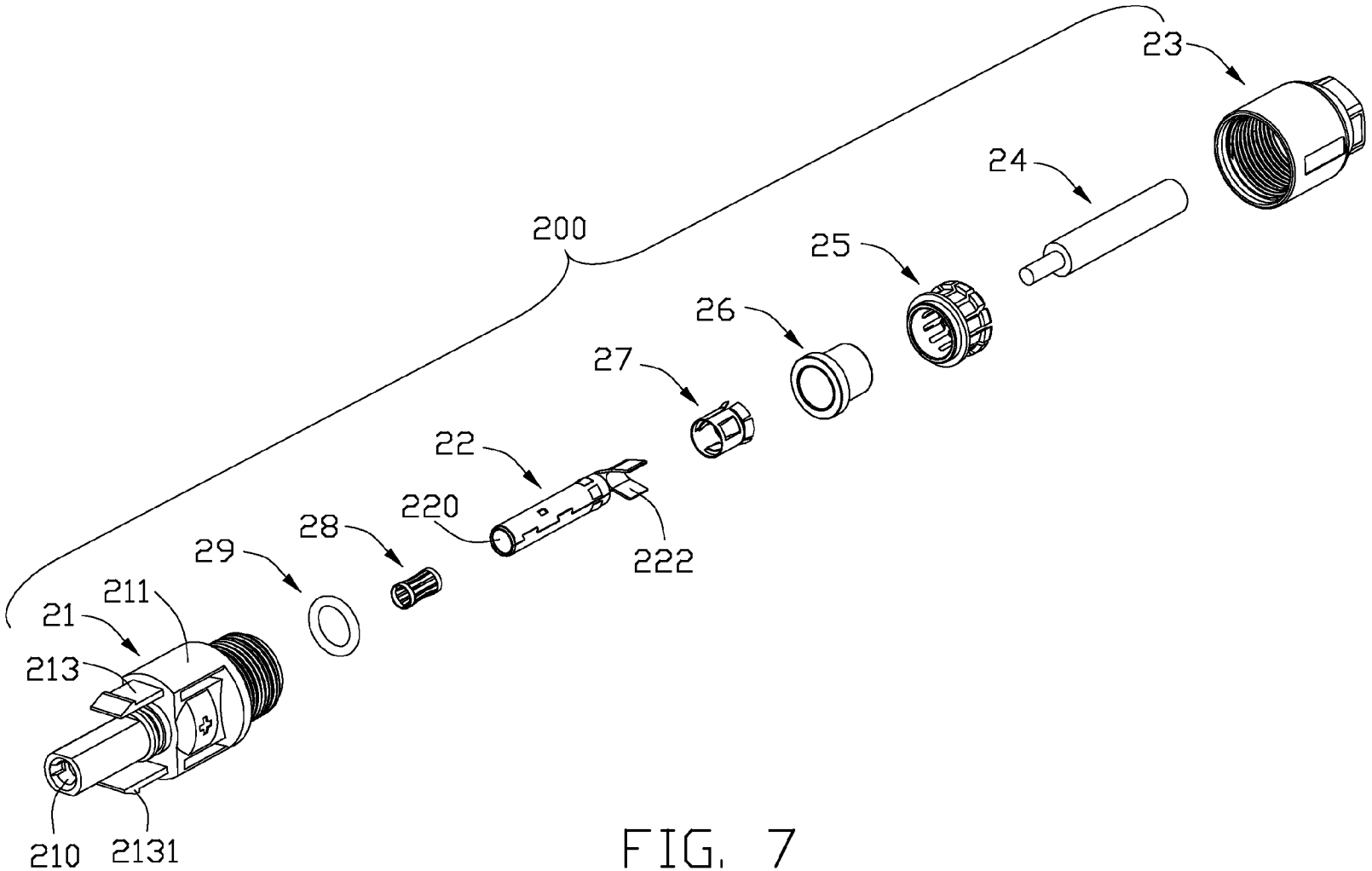
FIG. 7 is similar to FIG. 6, but viewed from another aspect.

Referring to FIGS. 6-8, the receptacle connector 200 comprises a receptacle housing 21, a tubular contact 22 accommodated in the receptacle housing 21, a cover 23 is assembled to the receptacle housing 21 and a cable 24 electrically connected with the tubular contact 22. The receptacle housing 21 comprises a main portion 211 with an external thread, a mating section 212 with a cavity 210, and a pair of latching arms 213 on opposite sides thereof. Each latching arm 213 is extending forwards from a front end of the main portion 211, and has a protruding portion 2131 on the side away from an axis of the mating section 212, the protruding portion 2131 is disposed on a front free end of the latching arm 213.

The tubular contact 22 is made of metallic material, and has a passage 220 for accommodating the columned contact 12 of the plug connector 100. The tubular contact 22 comprises a cylindrical body portion 221 and a tail portion 222 extending backwards from the body portion 221, a number of barbs 2212 are defined on the body portion 221 and neighboring to the tail portion 222. The body portion 221 of the tubular contact 22 has a larger diameter than the contacting portion 122 of the columned contact 12, so the tubular contact 22 can accommodate the columned contact 12.

The cover 23 of the receptacle connector 200 and the cover 13 of the plug connector 100 have the same configuration with each other, the receptacle connector 200 is similar to the plug connector 100 partially, and also comprises a shrinkable member 25, a sealing washer 26 and a metallic ring 27 enclosing the tubular contact 22 similar to the corresponding components of the plug connector 100. The tubular contact 22 is assembled into the receptacle housing 21, with the body portion 221 received in the cavity 210 of the mating section 212, and the cable 24 is electrically connected with the tail portion 222 of the tubular contact 22. The assembling between the sealing washer 26, the shrinkable member 25, the metallic ring 27, the cover 23, the plug housing 21 and the tubular contact 22 of the receptacle connector 200 is similar to the plug connector 100, and omitted.

In addition, the receptacle connector 200 also has an inner drum-shaped tube 28 assembled into a front section of the tubular contact 22.

The receptacle connector 200 also has a ringed waterproof washer 29, and the waterproof washer 29 is enclosing on the matching portion 212 of the receptacle housing 21.

While the receptacle connector 200 inserted into the receiving space 110 of the plug connector 100 along the mating direction, the columned contact 12 of the plug connector 100 is inserted into the tubular contact 22 of the receptacle connector 200 to form electrical connection, and the contacting portion 122 of the columned contact 12 is received in the passage 220 of the tubular contact 22 (shown in FIG. 8). The latching arms 213 of the receptacle connector 200 are inserted into the corresponding receiving slots 1123 of the plug connector 100 along the mating direction, and the protruding portions 2131 of the latching arms 213 are passing through the receiving slots 1123 and located in the receiving channels 1122, each protruding portion 2131 is adjacent to an inner wall of the corresponding protrusion 1121 and locked in the receiving channel 1122. The latching arms 213 are enclosed in the receiving slots 1123, and the protruding portions 2131 are shielding by the protrusions 1121, so a latch mechanism formed by the latching arms 213 and the protrusions 1121 can prevent the plug connector 100 separating from the receptacle connector 200, and a special tool is need to disengage therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector comprising:

a plug housing having a front base portion extending along a mating direction and a rear linking portion;

a contact received in the base portion;

a cover assembled to the linking portion; and a cable electrically connected with the contact;

wherein the base portion defines a front face, a pair of protrusions on an upper and a lower sides thereof, and a pair of receiving slots, the protrusions are defined neighboring to the front face of the base portion, each protrusion defines a receiving channel extending along a transverse direction, each receiving slot extends from the front surface along the mating direction to a corresponding receiving channel, the base portion has a cylindrical receiving space along a central axis thereof, and the receiving slots are disposed symmetrically with regard to the receiving space.

2. The plug connector as claimed in claim 1, further comprising a columnar contact received in the plug housing, the columned contact comprising a body portion, a contacting portion extending forwards from the body portion, and a tail portion behind the body portion.

3. The plug connector as claimed in claim 2, further comprising a plurality of barbs disposed on the body portion equi-distantly, the barbs having front ends connected with the body portion, and back ends extending outwards.

4. The plug connector as claimed in claim 3, further comprising a metallic ring enclosing the columnar contact, the ring having a hollow column at a front segment thereof, the column defining a plurality of bending portions extending inwards.

5. The plug connector as claimed in claim 4, wherein the ring has several tabs extending rearwards from a back end of the column, and the tabs extend outwards.

6. The plug connector as claimed in claim 4, wherein a front end of the ring is adjacent to the barbs of the columnar contact.

7. An electrical connector assembly comprising:

a plug connector having a plug housing, the plug housing having a front base portion extending along a mating direction and a rear linking portion, the plug connector further comprising: a contact received in the base portion; a cover assembled to the linking portion; and a cable electrically connected with the contact; wherein the base portion defines a front face, a pair of protrusions on an upper and a lower sides thereof, and a pair of receiving slots, each protrusion defining a receiving channel extending along a transverse direction, each receiving slot extending from the front surface along the mating direction to a corresponding receiving channel; and a receptacle connector having a pair of latching arms on opposite sides thereof, each latching arm defining a protruding portion on an outer side thereof, the receptacle connector also having a tubular contact and an inner drum-shaped tube assembled into a front section of the tubular contact;

wherein the latching arms are inserted into the receiving slots with the protruding portions shielded by the protrusions.

8. An electrical connector assembly comprising:

a first connector including:

a housing defining a front mating port with a front mating face thereon and a rear cover portion, the front mating port defining a rectangular configuration in a front view while the rear cover portion defining a cylindrical configuration in the front view;

a receiving space extending through the front mating face into the front mating port in a front-to-back direction;

a contact disposed in the receiving space;

at least a receiving slot extending through the front mating face along the front-to-back direction beside the receiving space;

a receiving channel extending through a side face of the housing and intersecting the receiving slot so as to form a locking shoulder around an interface of the receiving slot and the receiving channel for engagement with a latch of a second connector.

9. The electrical connector assembly as claimed in claim 8, wherein the second connector includes another housing with a front mating section adapted to be received in the receiving space and at least one latch with a hook at a free end for lockable engagement with the locking shoulder when and the first connector and the second connector are mated together, and the latch is inserted into the receiving slot.

10. The electrical connector assembly as claimed in claim 8, wherein the latch is unitarily formed with the second housing.

11. The electrical connector assembly as claimed in claim 10, wherein said another housing of the second connector defines a front mating surface, where the latch extends forward, for abutment with the front mating face of the first connector, when the first connector and the second connector are mated together and the latch extends into the receiving slot.

12. The electrical connector assembly as claimed in claim 8, wherein the receiving slot is isolated from the receiving space by the housing without transverse communication therebetween.

13. The electrical connector assembly as claimed in claim 12, wherein said housing defines a protrusion which is spaced behind the front mating face and which said receiving channel is formed in.

* * * * *